US011877632B1

(12) United States Patent
Mello

(10) Patent No.: US 11,877,632 B1
(45) Date of Patent: Jan. 23, 2024

(54) EARRING WITH FLEXIBLE POST

(71) Applicant: David Mello, Concord, MA (US)

(72) Inventor: David Mello, Concord, MA (US)

( * ) Notice: Subject to any disclaimer, the term of this patent is extended or adjusted under 35 U.S.C. 154(b) by 119 days.

(21) Appl. No.: 17/492,221

(22) Filed: Oct. 1, 2021

(51) Int. Cl.
*A44C 7/00* (2006.01)

(52) U.S. Cl.
CPC ..... *A44C 7/003* (2013.01)

(58) Field of Classification Search
CPC ..... Y10T 24/41; A44C 7/003
USPC ..... 63/12, 13
See application file for complete search history.

(56) References Cited

U.S. PATENT DOCUMENTS

| | | | | | |
|---|---|---|---|---|---|
| 161,853 | A * | 4/1875 | Baker | A44C 7/00 | 63/12 |
| 276,993 | A | 5/1883 | Amold | | |
| 625,890 | A * | 5/1899 | Mann | A44C 7/003 | 24/705 |
| 978,789 | A | 12/1910 | Stern | | |
| 1,324,466 | A | 12/1919 | Pirro | | |
| 2,373,002 | A | 4/1945 | Armstrong | | |
| 2,552,151 | A | 5/1951 | Cohen | | |
| 3,945,089 | A * | 3/1976 | Gagnon | A44C 7/003 | 63/12 |
| 4,139,993 | A | 2/1979 | Tucker | | |
| 4,245,484 | A | 1/1981 | Block | | |
| 4,353,370 | A * | 10/1982 | Evans | A61F 11/00 | 604/289 |
| 4,593,540 | A | 6/1986 | Cuvar | | |
| 5,020,338 | A | 6/1991 | Payne | | |
| 5,154,068 | A | 10/1992 | DiDomenico | | |
| 5,400,620 | A | 3/1995 | Cervo | | |
| 5,582,037 | A | 12/1996 | DiDomenico | | |
| 5,743,113 | A | 4/1998 | Kogen | | |
| 6,105,392 | A | 8/2000 | Biagi | | |
| 9,021,834 | B2 | 5/2015 | Jarrell | | |
| 10,905,206 | B1 | 2/2021 | Tashjin | | |
| 2007/0151294 | A1 | 7/2007 | Williams | | |
| 2010/0122553 | A1 | 5/2010 | Mueller | | |
| 2014/0116087 | A1 | 5/2014 | Giolando | | |
| 2021/0274894 | A1 * | 9/2021 | Weil | A44C 7/003 | |

* cited by examiner

*Primary Examiner* — Jack W Lavinder

(57) ABSTRACT

An earring comprises an ornamental structure and a flexible post attached to the ornamental structure; the flexible post can comprise an elastic material capable of returning to its original shape and form after being compressed and/or deformed. A flexible earring back can be provided that has a flexible post-engagement opening comprising a flexible material; the flexible material comprising an elastic material capable of returning to its original shape and form after being compressed and/or deformed. An earring comprises an ornamental structure and a post attached to the ornamental structure, wherein the post can include a breakaway structure proximal to a connection between the ornamental structure and the post to allow the ornamental structure and post to separate in response to an external force. The post can be rigid or flexible.

21 Claims, 11 Drawing Sheets

EARRING WITH FLEXIBLE POST

BACKGROUND

To date, earrings have been made with metal posts. Such posts can injure a wearer if the post get pulled, potentially cutting the ear. This is true with straight posts, but could be true with other types of posts too, such as curved metal posts.

For stud style earrings, typical posts are about 11 mm in length and have a post diameter of 0.85 mm. The post is smooth and has a round profile or cross section. Some posts have a locking notch set in about 2 mm from a distal end of the post, which can be referred to as the tip. The tip is smooth, well-rounded and highly polished. The tip is made to accommodate easy and painless insertion into a hole of a pierced ear.

An earring with a flexible post could provide safety benefits over existing earrings with metal posts that are rigid.

SUMMARY

In accordance with one aspect of the present disclosure, provided is an earring having a flexible, bendable post. The post, or a substantial portion thereof can be made of a flexible material, such as rubber, silicone, or the like, as examples. The post is made such that once bent from a neutral position it returns itself to the neutral position.

In various embodiments, the neutral position is straight.

In various embodiments, a substantial portion of the post is flexible.

In various embodiments, a post-earing connection is flexible.

In various embodiments, the earing is substantially all made of the flexible material.

In accordance with another aspect of the inventive concept, provided is an earring comprising an ornamental structure and a flexible post attached to the ornamental structure, the flexible post comprising an elastic material capable of returning to its original shape and form after being compressed and/or deformed from its original shape.

In various embodiments, the flexible post takes a neutral position in the absence of an external force.

In various embodiments, the flexible post is bendable in response to an external force and returns to the neutral position after removal of the external force.

In various embodiments, the flexible post is a bent post.

In various embodiments, the flexible post is a hook-shaped post.

In various embodiments, the flexible post is a substantially straight post.

In various embodiments, the earring is a stud earing.

In various embodiments, flexible post is about or equal to 11 mm in length and has a post diameter of about or equal to 0.85 mm.

In various embodiments, the flexible post includes a rounded end or a pointed end.

In various embodiments, the earring post is configured to receive an earring back and includes one or more structural elements configured to retain the earring back In various embodiments, the flexible post includes one or more radially extending protrusions distributed along a length of the flexible post.

In various embodiments, the flexible post includes one or more indentations distributed along a length of the flexible post.

In various embodiments, the flexible post includes one or more radially extending protrusions and one or more indentations distributed along a length of the flexible post.

In various embodiments, the flexible post includes a threaded portion for receipt of a threaded earring back.

In various embodiments, the flexible post comprises or is formed from rubber.

In various embodiments, the flexible post comprises or is formed from silicone.

In various embodiments, the flexible post is configured to receive an earring back.

In various embodiments, the earring back is configured for a friction or threaded engagement with the flexible post.

In various embodiments, the earring back is made from a metal.

In various embodiments, the earring back is configured for a compression engagement with the flexible post.

In various embodiments, the earring back includes is a flexible post-engagement opening comprising a flexible material, the flexible material comprising an elastic material capable of returning to its original shape and form after being compressed and/or deformed.

In various embodiments, the flexible earring back takes a form chosen from a group consisting of: a thin or thick disk, a sphere, a hemisphere, a cone, a cube, a cylinder, a prism, or other volumetric shape.

In various embodiments, when in the form of a disk, the flexible earring back takes a shape chosen from a group consisting of: a circle, an oval, a rectangle, a square, a hexagon, an octagon, or any other polygon shape.

In various embodiments, the flexible post-engagement opening is smaller in at least one dimension than a cross-section of the flexible post.

In various embodiments, the flexible post-engagement opening takes the form of at least one hole.

In various embodiments, the flexible post-engagement opening takes the form of at least two holes, each configured to collectively receive the flexible post.

In various embodiments, the flexible post-engagement opening takes the form of a slit.

In various embodiments, the flexible post-engagement opening includes a plurality of inwardly oriented protrusions.

In various embodiments, the flexible post-engagement opening takes the form of a plurality of slits forming a star pattern.

In various embodiments, the post has a surface that is textured.

In various embodiments, the flexible post has a locking notch set in about 2 mm from a distal end of the post.

In various embodiments, the flexible post includes a breakaway structure proximal to a connection between the ornamental structure and the flexible post.

In various embodiments, the breakaway structure comprises a breakaway notch having a diameter less than the diameter of the flexible post.

In various embodiments, the breakaway notch has a dimeter of about 0.5 mm or less.

In various embodiments, the breakaway notch has a dimeter of between about 0.1 mm to 0.3 mm.

In accordance with another aspect of the inventive concept, provided is an earring comprising an ornamental structure and a post attached to the ornamental structure, wherein the post includes a breakaway structure proximal to a connection between the ornamental structure and the post.

In various embodiments, the breakaway structure comprises a breakaway notch having a diameter less than the diameter of the post.

In various embodiments, the breakaway notch has a dimeter of about 0.5 mm or less.

In various embodiments, the breakaway notch has a dimeter of between about 0.1 mm to 0.3 mm.

In various embodiments, the post is a flexible post.

In various embodiments, the flexible post comprises an elastic material capable of returning to its original shape and form after being compressed and/or deformed.

In various embodiments, the post is a rigid post.

In various embodiments, the post is substantially straight.

In various embodiments, the post is bent or hook-shaped.

In accordance with various aspects of the inventive concepts, provided is a flexible earring back configured to removably secure on an earring post, comprising a flexible post-engagement opening comprising a flexible material, the flexible material comprising an elastic material capable of returning to its original shape and form after being compressed and/or deformed.

In various embodiments, the earring back is configured for a friction engagement with the post.

In various embodiments, the earring back is configured for a compression engagement with the post.

In various embodiments, the earring back is configured for a threaded engagement with the post.

In various embodiments, the flexible earring back takes a form chosen from a group consisting of: a thin or thick disk, a sphere, a hemisphere, a cone, a cube, a cylinder, a prism, or other volumetric shape.

In various embodiments, when in the form of a disk, the flexible earring back takes a shape chosen from a group consisting of: a circle, an oval, a rectangle, a square, a hexagon, an octagon, or any other polygon shape.

In various embodiments, the flexible post-engagement opening is smaller in at least one dimension that a cross-section of the post.

In various embodiments, the flexible post-engagement opening takes the form of at least one hole.

In various embodiments, the flexible post-engagement opening takes the form of at least two holes, each configured to collectively receive the flexible post.

In various embodiments, the flexible post-engagement opening takes the form of a slit.

In various embodiments, the flexible post-engagement opening includes a plurality of inwardly oriented protrusions.

In various embodiments, the flexible post-engagement opening takes the form of a plurality of slits forming a star pattern.

In accordance with aspects of the inventive concept, provided is an earring with a flexible post, as shown and described.

In accordance with aspects of the inventive concept, provided is an earring with a breakaway structure, as shown and described.

In accordance with aspects of the inventive concept, provided is a flexible earring back, as shown and described.

BRIEF DESCRIPTION OF THE DRAWINGS

The present invention will become more apparent in view of the attached drawings and accompanying detailed description. The embodiments depicted therein are provided by way of example, not by way of limitation, wherein like reference numerals refer to the same or similar elements. The drawings are not necessarily to scale, emphasis instead being placed upon illustrating aspects of the invention. In the drawings.

DETAILED DESCRIPTION OF PREFERRED EMBODIMENTS

Figure 1A:
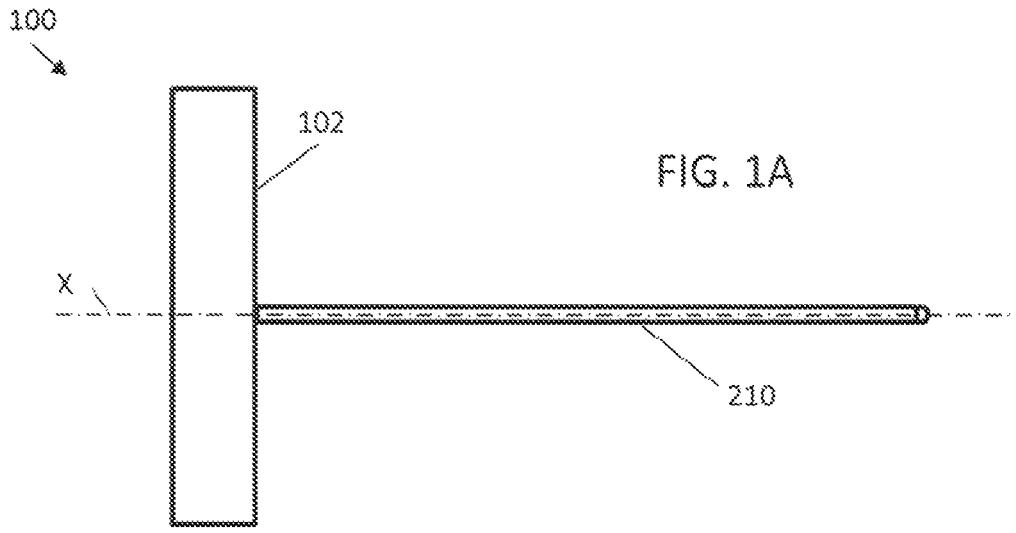
FIG. 1A is a side view of an embodiment of an earring with a flexible post, in accordance with aspects of the inventive concepts.

Various aspects of the inventive concepts will be described more fully hereinafter with reference to the accompanying drawings, in which some exemplary embodiments are shown. The present inventive concept may, however, be embodied in many different forms and should not be construed as limited to the exemplary embodiments set forth herein.

It will be understood that, although the terms first, second, etc. are be used herein to describe various elements, these elements should not be limited by these terms. These terms are used to distinguish one element from another, but not to imply a required sequence of elements. For example, a first element can be termed a second element, and, similarly, a second element can be termed a first element, without departing from the scope of the present invention. As used herein, the term "and/or" includes any and all combinations of one or more of the associated listed items.

It will be understood that when an element is referred to as being "on" or "connected" or "coupled" to another element, it can be directly on or connected or coupled to the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, steps, operations, elements, and/or components, but do not preclude the presence or addition of one or more other features, steps, operations, elements, components, and/or groups thereof.

Spatially relative terms, such as "beneath," "below," "lower," "above," "upper" and the like may be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as "below" and/or "beneath" other elements or features would then be oriented "above" the other elements or features. The device may be otherwise oriented (e.g., rotated 90 degrees or at other orientations) and the spatially relative descriptors used herein interpreted accordingly.

Exemplary embodiments are described herein with reference to cross-sectional illustrations that are schematic illustrations of idealized exemplary embodiments (and intermediate structures). As such, variations from the shapes of the illustrations as a result, for example, of manufacturing techniques and/or tolerances, are to be expected. Thus, exemplary embodiments should not be construed as limited to the particular shapes of regions illustrated herein but are to include deviations in shapes that result, for example, from manufacturing.

In accordance with aspects of the inventive concepts, an earring having a flexible post is provided. The flexible post extends from an ornamental structure (or portion) of the earring. A flexible post is a post that is capable of bending easily from a neutral without breaking, and preferably returns to the neutral position after bending. The neutral position is a position of the post without external stresses applied. The post can have the same dimensions in terms of length and diameter as typical earrings. In various embodiments, the flexible posts is about, or equal to, 11 mm in length and has a post diameter of about or equal to 0.85 mm. In various embodiments, the post is smooth and has a round profile or cross section, but in other embodiments a surface of the post can be textured, e.g., having protrusions and/or indentations or patterns thereon. In some embodiments, the post can have a polygonal cross section. In some embodiments, the post has a locking notch set in about 2 mm from the distal end of the prong, can be referred to as the tip.

For example, a neutral position of an earring post for many styles of earrings is straight. Such earing styles include stud style earrings. For other styles of earrings, the flexible post is curved or hook-shaped as a neutral position. In various embodiments, whether straight or curved, the flexible post may optionally include one or more locking notches.

The flexible post can be made from one or more flexible materials, such as rubber, silicone, plastic, and so forth. The flexible post may be smooth, or include one or more depressions and/or protrusions distributed along its length. Such depressions and/or protrusions can be constructed and arranged to engage an earring back to maintain and/or retain the earring back in place while the earring is being worn. The flexible post can include a rounded (bullet) end or a pointed end. Therefore, in various embodiments, the earring post can include one or more structural elements, e.g., magnets, detents, indentations, and/or protrusions, configured to receive and retain an earring back.

A back used with the flexible post may take the form of any traditional back, including metal backs. Traditional earring backs can include friction backs and threaded earring backs. However, in some embodiments, the earring back can also be made of a flexible material, similar to the earing post. In these embodiments, the flexible earring back can take the form of a traditional back, e.g., friction or threaded earring back, but made from or include a flexible material directly engaging the flexible post.

In other embodiments, the earring back can be made of a different, non-traditional form, such as a piece of material having an opening comprising a flexible material constructed to receive the flexible post, which can be referred to as a flexible post-engagement opening. The flexible earring back can take any of a variety of forms, such as a thin or thick disk, a sphere, a hemisphere, a cone, a cube, a cylinder, a prism, or other volumetric shape. If in the shape of a disk, the flexible earring back can take the shape of a circle, oval, rectangle, square, or other shape.

The hole or opening can pass or be formed through the flexible earring back, to allow the flexible post to pass through the earring back. The hole can define at least one opening that is at least slightly smaller than the post cross-section, e.g., by more than 0 mm and up to 3 mm. As such, a friction and/or compression fit can be formed between the flexible post and the flexible earring back when the post is passed through the opening.

FIGS. 1A-1E provide different view of an embodiment of an earring 100 with a flexible post 110, in accordance with aspects of the inventive concept. The earring 100 includes an ornamental portion, such as a jewel or design piece. The flexible post 110 extends from a back or back surface of the ornamental portion 102. Here, the flexible post 110 extends along an axis "X" from the back surface of the ornamental portion 102. In some embodiments, the flexible post 110 extends substantially perpendicular from the back surface of the ornamental portion 102.

Figure 1B:
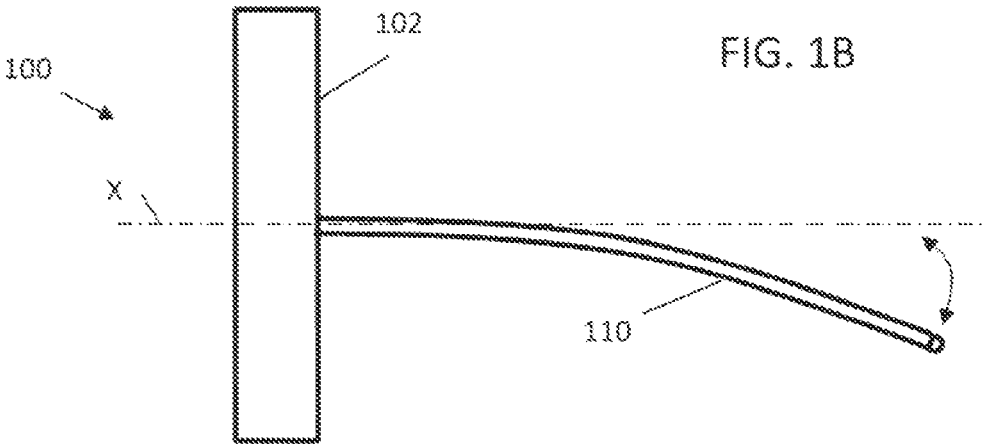
FIG. 1B is a side view of the earring with a flexible post of FIG. 1A with the post flexed.
Figure 1C:
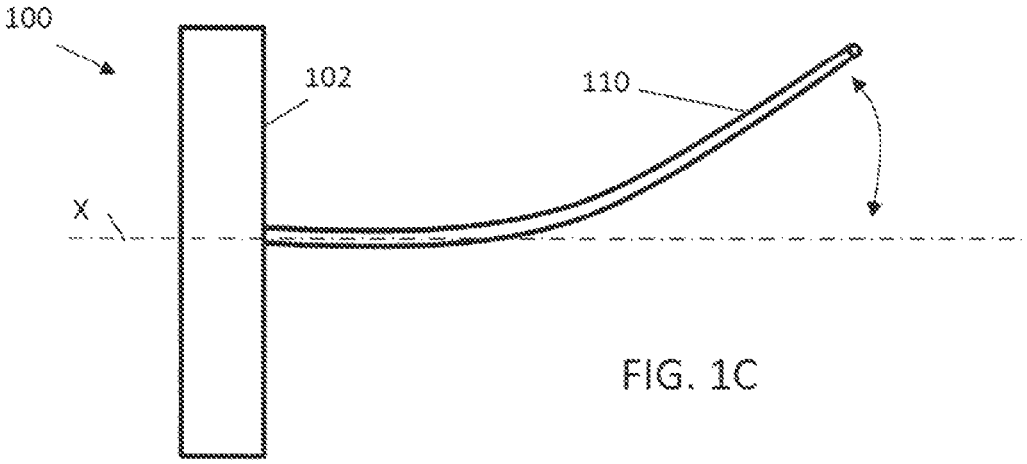
FIG. 1C is another side view of the earring with a flexible post of FIG. 1A with the post flexed.
Figure 1D:
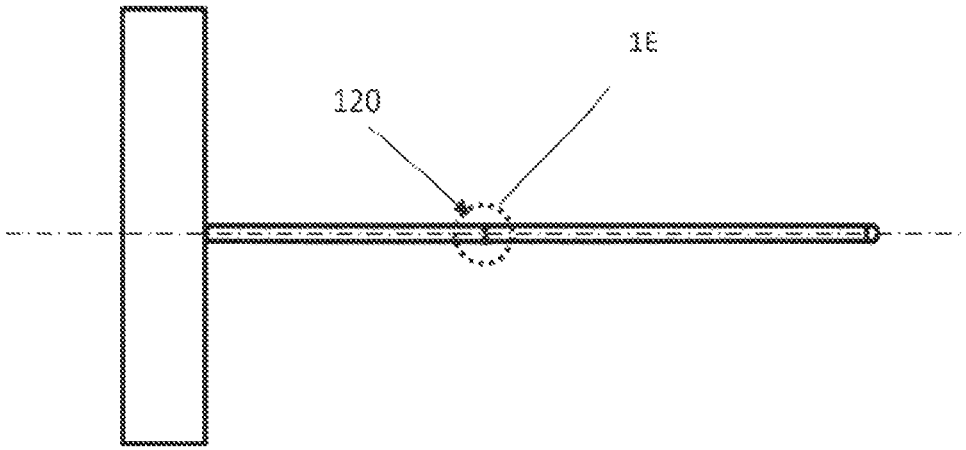
FIG. 1D is a side view of an embodiment of an earring with a flexible post having a notch, in accordance with aspects of the inventive concepts.
Figure 1E:
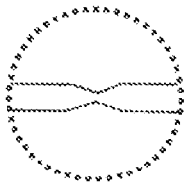
FIG. 1E is a side view of the notch of the earring with a flexible post of FIG. 1D.

In some embodiments, the flexible post 110 can include at least one optional notch 120, see FIGS. 1D and 1E. The optional notch 120 can serve as a predetermined location for placement of an earring back used to secure the earring to an ear.

FIG. 1B shows the flexible post partially flexed downwardly from the axis X. FIG. 1C shows the flexible post having a greater flex as compared to FIG. 1B. In the preferred form, the flexible post can be flexed as shown in FIGS. 1B and/or 1C in response to an external force, but returns to a neutral position along axis X when the external force is removed.

In various embodiments, the flexible post 110 comprises an elastic and/or memory material capable of returning to its original shape and form after being compressed and/or deformed. In various embodiments, the flexible post 110 can be made from or comprise silicone, rubber, and/or a similar flexible material with elastic and/or memory properties. In various embodiments, the flexible post is compressible, to help make a compression fit with an earring back.

Figure 2A:
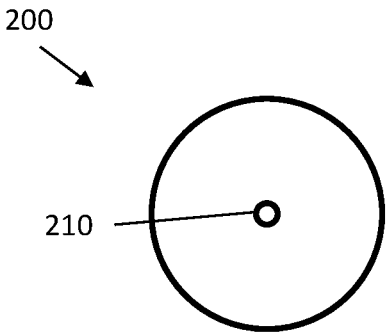
FIG. 2A shows an embodiment of a flexible earring back, in accordance with aspects of the inventive concepts.
Figure 2B:
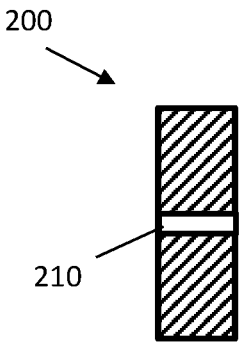
FIG. 2B is a side cross sectional view of the earing back of FIG. 2A.

FIGS. 2A-B show an embodiment of an earring back 200, in accordance with aspects of the inventive concept. FIG. 2A provides a front/back view of the earring back 200 and FIG. 2B provides a section view of the earring back 200. In this embodiment, the earing back 200 is generally disk-shaped, but other shapes could be used. The earing back 20 has an opening in the form of a hole 210 configured to receive the flexible post 110. The earring back 200 can also be made of a flexible material, e.g., silicone or rubber, or at least the material in which the opening is formed can be made of such a flexible material, even if other portions of the back are made from a more rigid material.

The hole opening 210 can be sized to have a smaller cross section, at least in one dimension, than the earring post 110 to help form the compression fit between the flexible post 110 and the earring back opening 210. For example, a diameter of a circular opening 210 can be less that than of the flexible post 110. In other embodiments, rather than being a circular opening 210, the opening could be oval or some other shape.

Figure 3A:
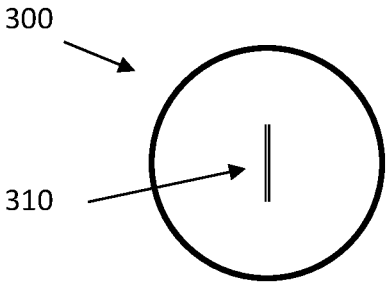
FIG. 3A shows another embodiment of a flexible earring back, in accordance with aspects of the inventive concepts.
Figure 3B:
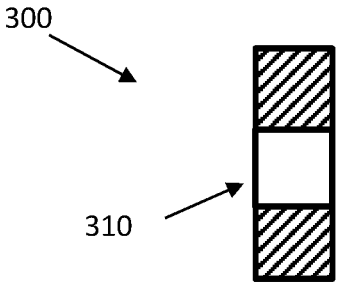
FIG. 3B is a side cross sectional view of the earing back of FIG. 3A.

FIGS. 3A-B show another embodiment of an earring back 300, in accordance with aspects of the inventive concept. FIG. 3A provides a front/back view of the earring back 300 and FIG. 3B provides a section view of the earring back 300. In this embodiment, the earing back 300 is generally disk shaped, but other shapes could be used. The earing back 300 has an opening in the form of a slit 310 configured to receive the flexible post 100. The earring back can also be made of a flexible material, e.g., silicone or rubber, or at least the material in which the opening is formed can be made of such a flexible material even if other portions of the back 300 are made from a more rigid material.

The slit opening 310 can be sized to have a smaller cross section, at least in one dimension, than the earring post 110 to help form the compression fit between the flexible post and the earring back slit 310. In fact, with use of the slit 310, the opening can have a negligible width when the post 110 in not received therein.

Figure 4:
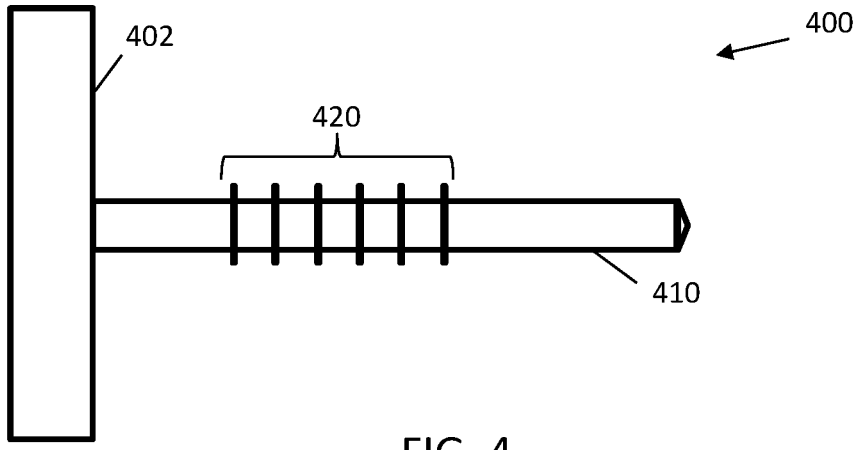
FIG. 4 provides a side view of another embodiment of an earring with a flexible post, in accordance with aspects of the inventive concepts.

FIG. 4 provides a side view of another embodiment of an earring 400 with a flexible post, in accordance with aspects of the inventive concept. The earring 400 includes an ornamental portion or structure 402, such as a jewel or design piece. The flexible post 410 extends from a back or back surface of the ornamental portion 402. Here, the flexible post 410 extends along an axis "X" from the back surface of the ornamental portion 402. In some embodiments, the flexible post 410 extends substantially perpendicular from the back surface of the ornamental portion 402.

In some embodiments, the flexible post 410 can include one or more protrusions 420 radially extending from the flexible post 410. The optional protrusions 420 can serve as predetermined locations for placement of an earring back used to secure the earring to an ear. Optionally, the protrusions can serve as stops that keep the earring on the ear, like a built-in earning back. In such cases, the flexible post 410 could be used without an earring back.

As with FIGS. 1B-1C, the flexible post 410 can be flexed from the axis X in response to an external force, but returns to a neutral position along axis X when the external force is removed.

Figure 5:
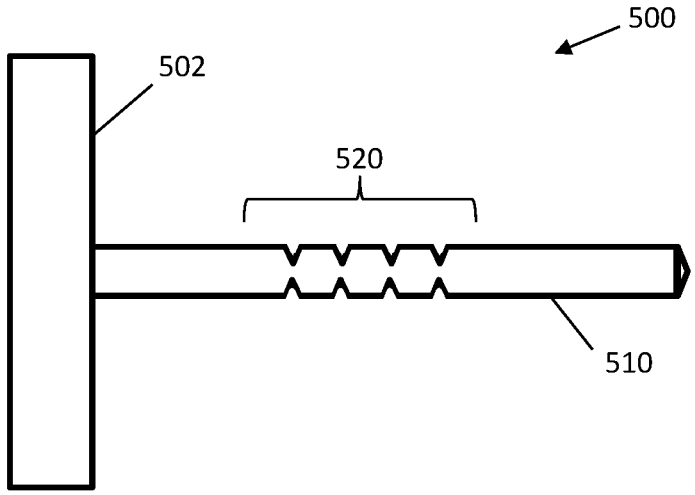
FIG. 5 provides a side view of another embodiment of an earring with a flexible post, in accordance with aspects of the inventive concepts.

FIG. 5 provides a side view of another embodiment of an earring 500 with a flexible post 510, in accordance with aspects of the inventive concept. The earring 500 includes an ornamental portion or structure 502, such as a jewel or design piece. The flexible post 510 extends from a back or back surface of the ornamental portion 502. Here, the flexible post 510 extends along an axis "X" from the back surface of the ornamental portion 502. In some embodiments, the flexible post 510 extends substantially perpendicular from the back surface of the ornamental portion 502.

In some embodiments, the flexible post 510 can include a plurality of notches 520, indentations, or channels radially formed in the flexible post. The optional notches 520 can serve as predetermined locations for placement of an earring back, such as those described above, used to secure the earring to an ear.

As with FIGS. 1B-1C, the flexible post 510 can be flexed from the axis X in response to an external force, but returns to a neutral position along axis X when the external force is removed.

Figure 6A:
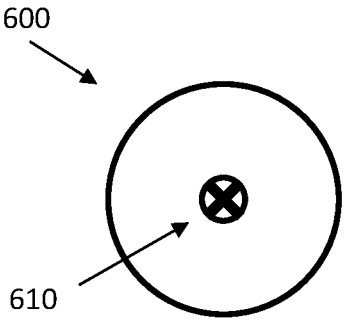
FIG. 6A shows another embodiment of a flexible earring back, in accordance with aspects of the inventive concepts.
Figure 6B:
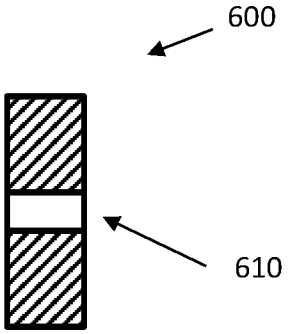
FIG. 6B is a side cross sectional view of the earing back of FIG. 6A.

FIGS. 6A-B show an embodiment of an earring back 600, in accordance with aspects of the inventive concept. FIG. 6A provides a front/back view of the earring back 600 and FIG. 6B provides a section view of the earring back 600. In this embodiment, the earing back is generally disk shaped, but other shapes could be used. The earing back 600 has an opening in the form of a hole 610 with protrusions configured to receive the flexible post. The earring back 600 can also be made of a flexible material, e.g., silicone or rubber, or at least the material in which the opening is formed can be made of such a flexible material even if other portions of the back are made from a more rigid material.

The opening with protrusions 610 can be sized to have a smaller cross section, at least in one dimension, than the earring post to help form the compression fit between the flexible post and the earring back 610.

Figure 7A:
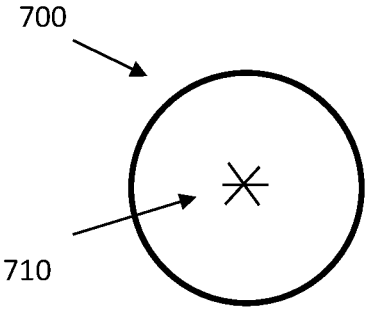
FIG. 7A shows another embodiment of a flexible earring back, in accordance with aspects of the inventive concepts.
Figure 7B:
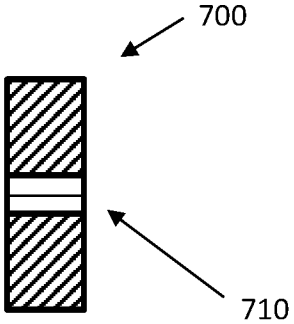
FIG. 7B is a side cross sectional view of the earing back of FIG. 7A.

FIGS. 7A-B show an embodiment of an earring back 700, in accordance with aspects of the inventive concept. FIG. 7A provides a front/back view of the earring back 700 and FIG. 7B provides a section view of the earring back 700. In this embodiment, the earing back is generally disk shaped, but other shapes could be used. The earing back 700 has an opening in the form of a plurality of slits 710 making a "star" pattern configured to receive the flexible post. The earring back 700 can also be made of a flexible material, e.g., silicone or rubber, or at least the material in which the opening 710 is formed can be made of a flexible material even if other portions of the back are made from a more rigid material.

The star opening 710 can be sized to have a smaller cross section, at least in one dimension, than the earring post to help form the compression fit between the flexible post and the earring back 700. In fact, with use of the star, the opening can have a negligible width when the post in not received therein.

Figure 8A:
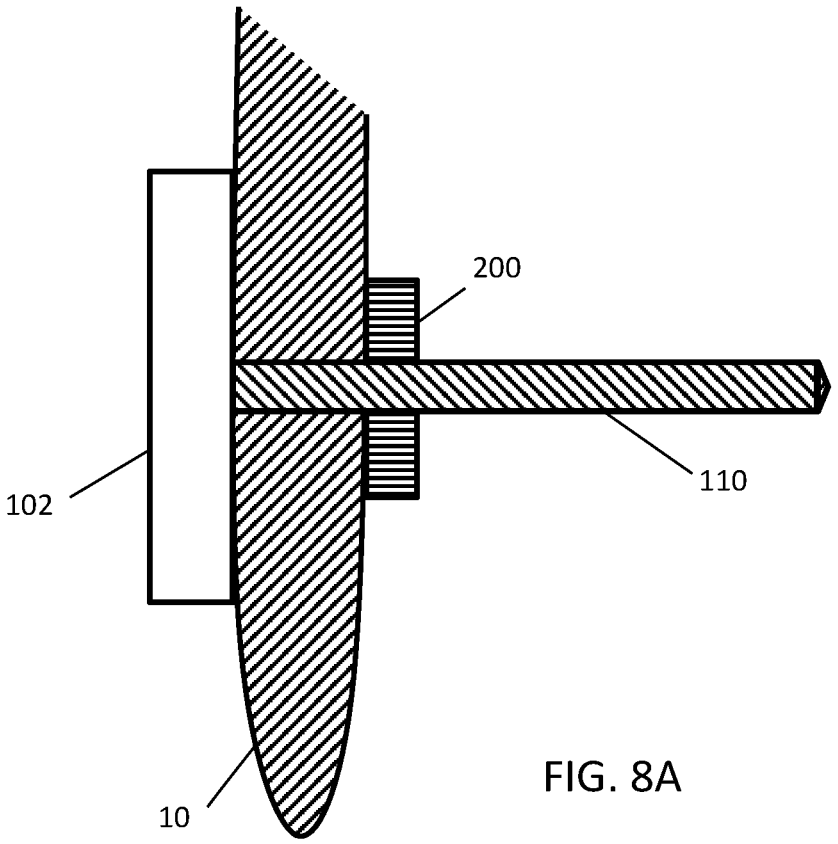
FIG. 8A shows an embodiment of an earring with flexible post without notches or protrusions affixed to an ear with an earring back, in accordance with aspects of the inventive concepts.

FIG. 8A shows an embodiment of the earring 100 with flexible post 110 without notches or protrusions affixed to an ear 10 with an earring back 200, in accordance with aspects of the inventive concept. The earring back 200 can also comprise a flexible material, particularly where it receives the flexible post 110. In FIG. 8A the ear 10 is shown as sectioned to demonstrate the flexible earring post 100 and back 200.

Figure 8B:
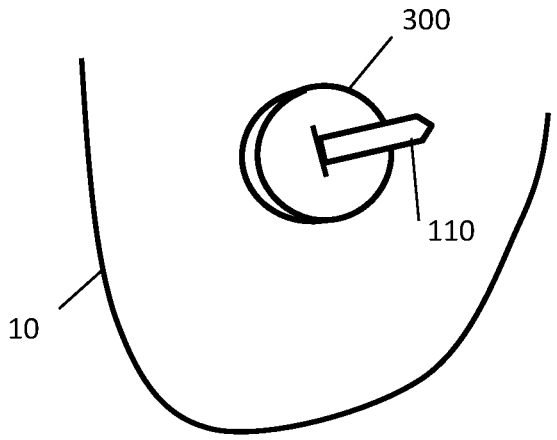
FIG. 8B shows a perspective view of the earring and earring back of FIG. 8A.

FIG. 8B shows a perspective view of the earring 100 and earring back 300 of FIG. 3A. In this view, the earring back with slit opening 310 of FIGS. 3A and 3B is shown.

Figure 9A:
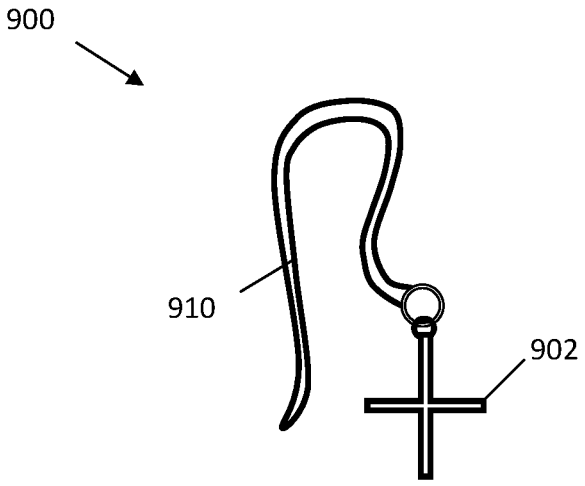
FIG. 9A shows another embodiment of an earring with a flexible post, where the flexible post takes for the form of a hook rather than a substantially straight post, in accordance with aspects of the inventive concepts.
Figure 9B:
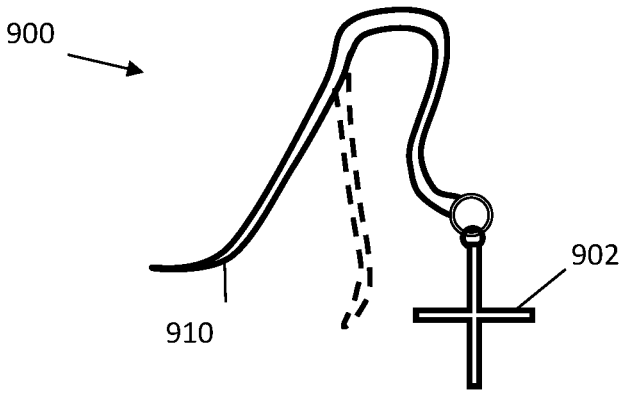
FIG. 9B shows the earring with a flexible post of FIG. 9A with the flexible post flexed.

FIGS. 9A and 9B show another embodiment of an earring 900 with a flexible post 910, where the flexible post 910 takes the form of a hook rather than a substantially straight post. The earring 900 includes an ornamental portion 902, such as a jewel or design piece. The flexible post 910 extends from a portion of the ornamental portion 902.

FIG. 9A shows a view of the earring 900 with flexible post 910 with the flexible post in a neutral, not-flexed position. FIG. 9B shows the flexible post 910 partially flexed upwardly from the neutral position. In the preferred form, the flexible post 910 is flexed as shown in FIG. 9B in response to an external force, but returns to the neutral position when the external force is removed.

In various embodiments, the flexible post 910 can be made from or comprise, silicone, rubber, or a similar flexible material with elastic and/or memory properties. In various embodiments, the flexible post 910 is compressible, to help form a compression fit with an earring back, although an earring back is not required for the hook-shaped post 910.

Regarding the various embodiments disclosed herein, as will be appreciated by those skilled in the art, a more traditional back could be used with the flexible post in some embodiments. And, in other embodiments, the earring back with flexible opening could be used to a more traditional rigid earring post.

The flexible post has been shown with two styles of earrings, but could be applied to any form of earring or other jewelry used with a piercing. The flexible post provides much greater safety as compared to traditional rigid posts, which can tear the flesh under a certain amount of external pushing or pulling. The flexible post avoids such injury.

Figure 10B:
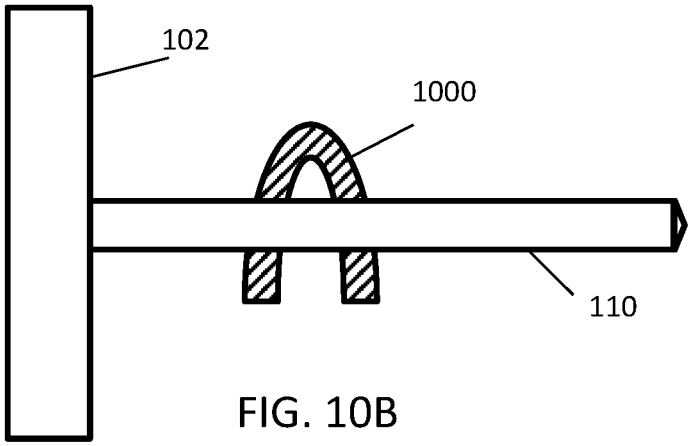
FIG. 10B shows an earring with flexible post with the earring back of FIG. 10A.
Figure 10A:
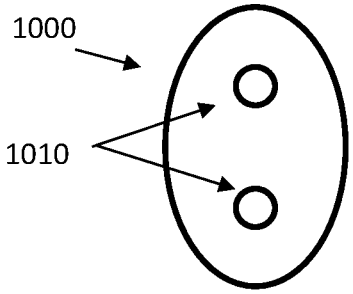
FIG. 10A shows a flexible, bendable earring back with two holes, in accordance with aspects of the inventive concepts.

Referring to FIGS. 10A and 10B, in some embodiments, an earring back 1000 can include two holes 1010 and the flexible earing post 110 can be used with the flexible back 1000 by passing the flexible post 110 through both holes 1010 of the flexible earing back 1000. This can be accomplished by folding a disk-shaped flexible earing back 1000 to align first and second holes 1010 thereof and then passing the flexible post through the aligned holes, e.g., as shown in FIGS. 10A and 10B. In FIG. 10B, the earring back 1000 is shown in cross section. Thereafter, when the folded earring back 1000 is released, the folded earring back will attempt to return to its unfolded configuration, thereby applying a pressure to the post to assist in maintaining the flexible earing back 1000 on the flexible post 110.

The flexible earring back 1000 can be used with a flexible post earring or a traditional metal post earring.

Figure 11:
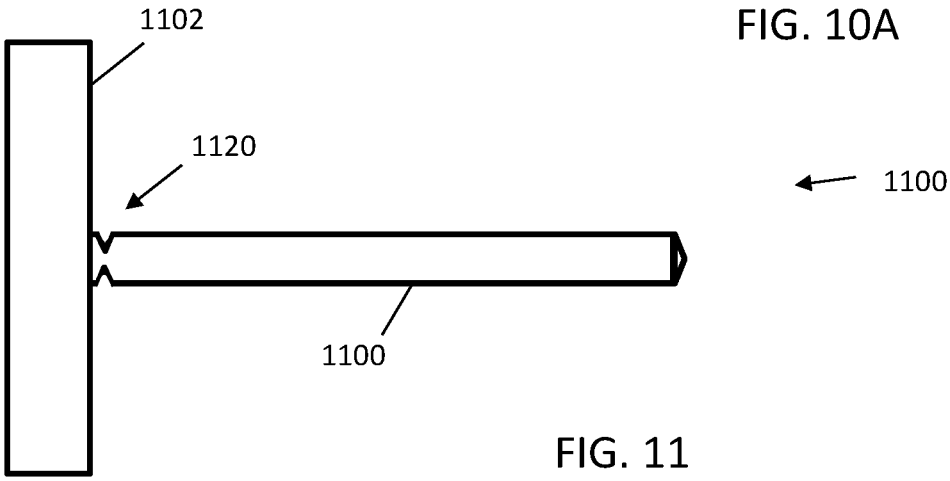
FIG. 11 is a side view of an earring with a breakaway structure, in accordance with aspects of the inventive concepts.

FIG. 11 is a side view of an embodiment of an earring 1100 having a post 1110 with a breakaway structure 1120, in accordance with aspects of the inventive concept. The breakaway structure 1120 is located proximate to the ornamental structure 1102 of the earring 1100. If an external force, such as a push, pull, or sheer force, applied to the earring can cause the post to break at the breakaway structure 1120 causing the ornamental structure 1102 to separate, e.g., break away, from the post 1110 to avoid injury to the ear, such as tearing of the ear lobe. In some embodiments, the post 1110 can be a flexible post, as described above, or a rigid post, such as a metal post. In some embodiments, the breakaway structure 1120 can be formed in post 1110 adjacent to the ornamental structure 1102.

In the embodiment shown, the breakaway structure 1120 takes the form of a breakaway notch having a diameter of about 0.5 mm or less. In some embodiments, the breakaway notch has a diameter of between about 0.1 mm to 0.3 mm.

In other embodiments, the breakaway structure 1120 can be a reusable connection, such as a snap or plug fit between the ornamental structure and the post. In some embodiments, the reusable connection between the post and ornamental structure can be or include a magnetic coupling, e.g., a metal post made from an attracted to magnets and magnetic ornamental structure or vice versa.

In some embodiments, the post can be a flexible post as discussed above. In other embodiments, the post can be a rigid post.

Figure 12A:
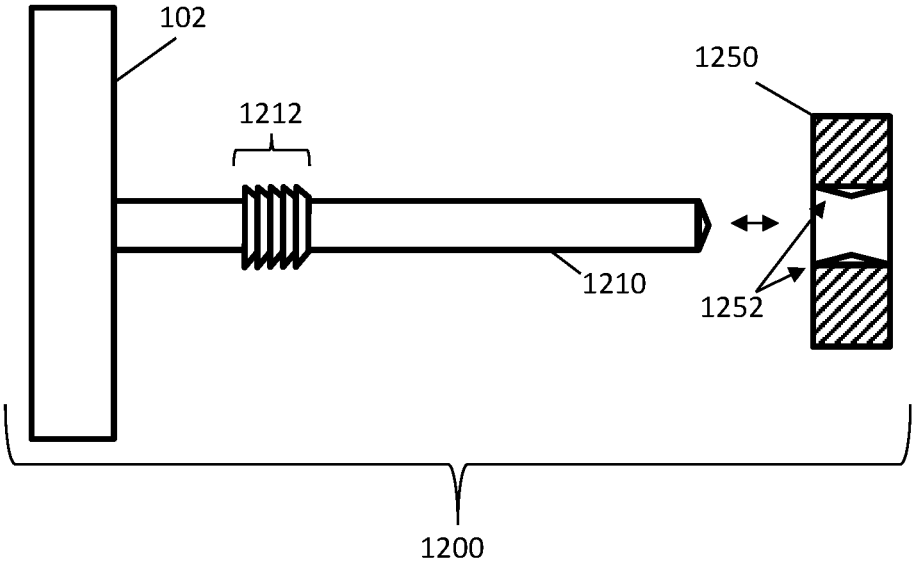
FIG. 12A is a side view of an earring with an earring back engagement structure comprising a plurality of ridges, in accordance with aspects of the inventive concepts.
Figure 12B:
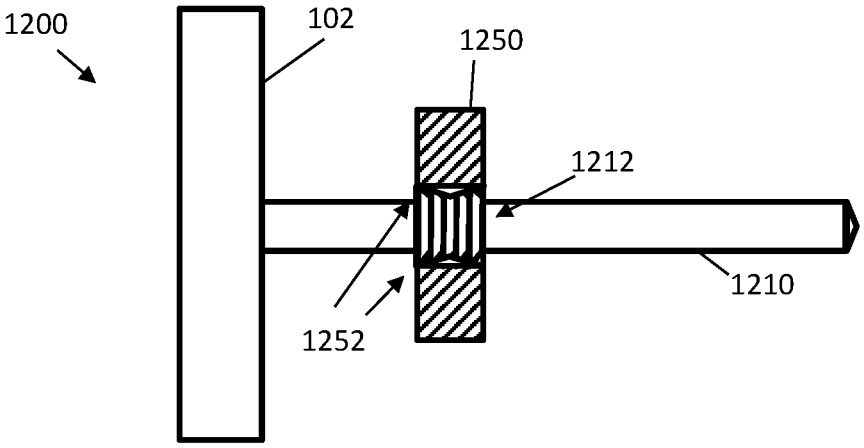
FIG. 12B shows the earring of FIG. 12A with the earring back on the flexible post.

FIGS. 12A-B is a side view of an earring 1200 with a post 1210 having an earring back engagement structure comprising a plurality of ridges 1212, in accordance with aspects of the inventive concept. In this embodiment, the engagement structure is located on the post 1210 and has a span where the earring back is likely to be located when used to secure the earring 1200 to an ear. In this embodiment, the ridges 1212 have two sides, a first side closest to the ornamental structure 1202 and a second side farther from the ornamental structure 1202. The first side and/or the second side can be perpendicular with respect to the X-axis of the post 1210, or sloped toward or away from the ornamental structure 1202. In some embodiments, the slope can be between 0 and 45 degrees with respect a Y-axis that is perpendicular with respect to the X-axis. The post 1210 can be flexible or rigid.

The earring back 1250 is shown in cross-section. It has a protrusion 1252 that engages with the ridges 1212 on the earring post 1210 to help retain the earring back 1250 on the post 1210 when the earring is worn. FIG. 12B shows the earring back 1250 on the post 1210, with the protrusion 1252 of the earring back engaged with the ridges 1212 of the post.

Figure 13:
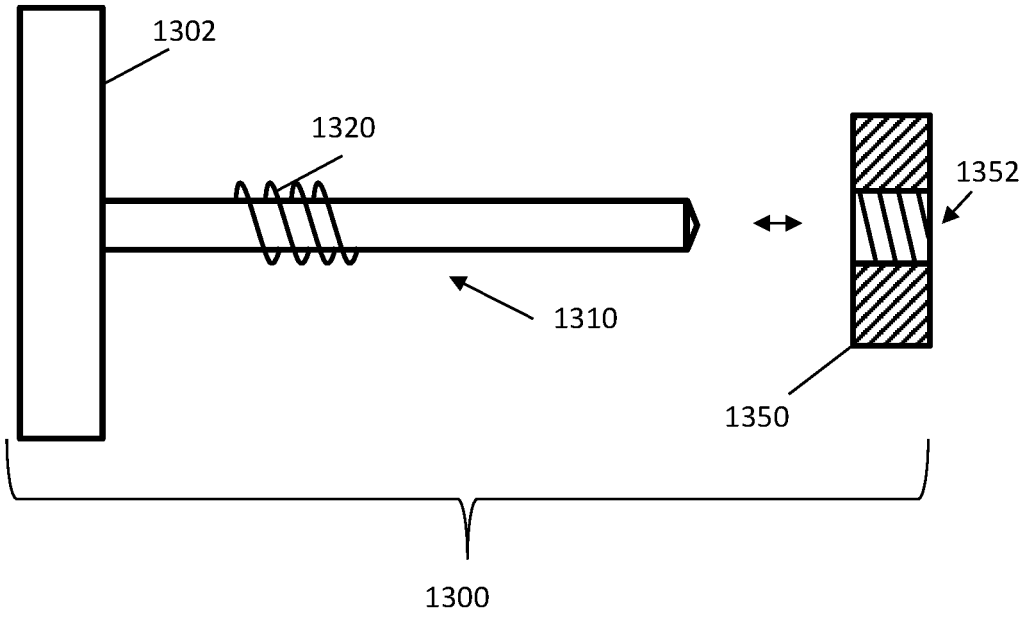
FIG. 13 is a side view of an earring with an earring back engagement structure comprising a threaded structure, in accordance with aspects of the inventive concepts.

FIG. 13 is a side view of an embodiment of an earring 1300 with an earring back engagement structure comprising a post 1310 having a threaded structure 1320, in accordance with aspects of the inventive concept. The post 1310 can be a flexible or rigid post. The earring back 1350 can be correspondingly threaded, as shown in cross-section, and can be made of a flexible material or be rigid. In one embodiment, post 1310 and earring back 1350 are made of a flexible material.

Figure 14:
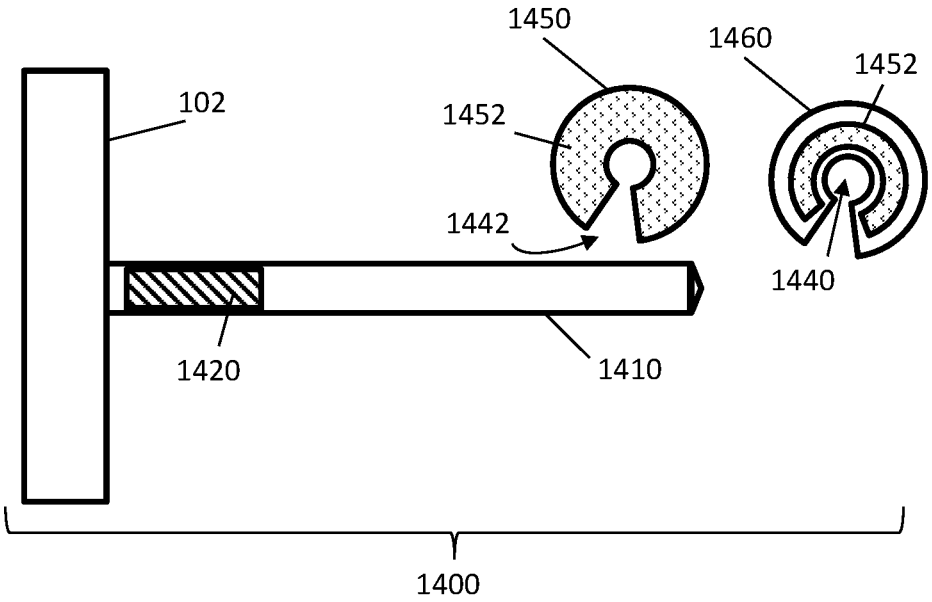
FIG. 14 is a side view of an embodiment of an earring and an earring back structured for magnetic engagement, in accordance with aspects of the inventive concepts.

FIG. 14 is a side view of an embodiment of an earring and an earring back structured for magnetic engagement, in accordance with aspects of the inventive concepts. The earring comprises an ornamental structure 102 and a post 1410 comprising a magnetic or magnetically attractive element or material 1420. In some embodiments, the earring post 1410, or portions thereof, can comprise or be formed of the magnetic or magnetically attractive element or material 1420 and can be configured to receive and maintain an earring back 1450, 1460. In various embodiments, the earing post 1410 is a flexible earring post.

In various embodiments, the earring back 1450, 1460 can comprise or be formed of a magnetic or magnetically attractive element or material 1452. In some embodiments, the earring back 1450, 1460 can be formed of or include a compressible material and/or a rigid material. In various embodiments, the magnetic or magnetically attractive element or material 1420 of the post 1410 can be disposed within the post and below an outer surface of the post. In various embodiments, the magnetic or magnetically attractive element or material of the post can be exposed at an outer surface of the post or be disposed on an outer surface of the post.

As shown in FIG. 14, in various embodiments, the earring back 1450, 1460 can having a side opening or cut 1442 defining a path to an open portion 1440 that receives the earring post. In such embodiments, the earring back can have a c-shape. In some embodiments, the earring back 1450, 1460 need not comprise a magnetic or magnetically attractive material or element. In various embodiments, the earring back or portions thereof that define the opening 1442 can be formed of or include a compressible material to aid in forming a press or snap fit with the earring post.

While the foregoing has described what are considered to be the best mode and/or other preferred embodiments, it is understood that various modifications can be made therein and that the invention or inventions may be implemented in various forms and embodiments, and that they may be applied in numerous applications, only some of which have been described herein. It is intended by the following claims to claim that which is literally described and all equivalents thereto, including all modifications and variations that fall within the scope of each claim.

What is claimed is:

1. An earring, comprising:

an ornamental structure; and a flexible post extending from the ornamental structure, the flexible post comprising an elastic material capable of returning to its original shape and form after being compressed and/or deformed, the flexible post having a distal end configured to slidingly receive an earring back, wherein the flexible post includes one or more protrusions radially extending from the flexible post at predetermined locations to form stops configured to receive and retain the earring back to secure the earring to an ear, wherein the flexible post comprises a magnetic or magnetically attractive material or element.

2. The earring of claim 1, wherein the flexible post takes a neutral position in the absence of an external force, and wherein the flexible post is bendable in response to an external force and returns to the neutral position after removal of the external force.

3. The earring of claim 1, wherein the flexible post is a substantially straight post.

4. The earring of claim 1, wherein the earring is a stud earing.

5. The earring of claim 1, wherein the flexible post includes a threaded portion for receipt of a threaded earring back.

6. The earring of claim 1, wherein the flexible post comprises at least one of rubber and silicone.

7. The earring of claim 1, wherein the flexible post has a substantially uniform diameter from the ornamental structure to the distal end.

8. The earring of claim 1, wherein the one or more protrusions comprises at least one ridge.

9. An earring kit, comprising:

an ornamental structure;

a flexible post extending from the ornamental structure, the flexible post comprising an elastic material capable of returning to its original shape and form after being compressed or deformed, wherein the flexible post takes a neutral position in the absence of an external force and wherein the flexible post includes one or more protrusions radially extending from the flexible post at predetermined locations to form stops configured to receive and retain an earring back to secure the earring to an ear; and an earring back having a flexible post engagement opening formed therethrough with a cross-section smaller in at least one dimension than a diameter of the flexible post and/or the one or more protrusions, wherein the earring back is configured to receive a distal end of the flexible post through the flexible post engagement opening to form a compression fit between the flexible post and the earring back and to engage the one or more protrusions of the flexible post, wherein the earring back takes a form chosen from a group consisting of: a disk, a sphere, a hemisphere, a cone, a cube, a cylinder, c-shape; or a prism.

10. The earring of claim 9, wherein the earring back flexible post-engagement opening comprises a compressible material to engage the flexible post.

11. The earring kit of claim 9, wherein the one or more protrusions comprises at least one ridge.

12. An earring kit, comprising:

an ornamental structure; and a flexible post extending substantially perpendicular from a back surface of the ornamental structure, the flexible post comprising an elastic material capable of returning to its original shape and form after being compressed or deformed, wherein the flexible post includes one or more protrusions radially extending from the flexible post at predetermined locations to form stops configured to receive and retain an earring back; and the earring back having a flexible post engagement opening comprising at least one protrusion configured to engage the one or more protrusions of the flexible post to secure the earring to an ear.

13. The earring kit of claim 12, wherein the earring back is configured to slidingly receive the flexible post.

14. The earring kit of claim 12, wherein the flexible post-engagement opening comprises a compressible material configured to engage the flexible post.

15. The earring kit of claim 12, wherein the flexible post is a solid post.

16. The earring kit of claim 12, wherein the earring back takes a form chosen from a group consisting of: a disk, a sphere, a hemisphere, a cone, a cube, a cylinder, c-shape; or a prism.

17. The earring kit of claim 12, wherein the earring back flexible post engagement opening is configured to form a compression fit between the flexible post and the earring back and to engage the one or more protrusions of the flexible post.

18. The earring kit of claim 12, wherein the earring back flexible post engagement opening comprises at least one slit.

19. The earring kit of claim 12, wherein the one or more protrusions comprises at least one ridge.

20. An earring kit of claim 9, comprising:

an ornamental structure;

a flexible post extending from the ornamental structure, the flexible post comprising an elastic material capable of returning to its original shape and form after being compressed or deformed, wherein the flexible post takes a neutral position in the absence of an external force and wherein the flexible post includes one or more protrusions radially extending from the flexible post at predetermined locations to form stops configured to receive and retain an earring back to secure the earring to an ear; and an earring back having a flexible post engagement opening formed therethrough with a cross-section smaller in at least one dimension than a diameter of the flexible post and/or the one or more protrusions, wherein the earring back is configured to receive a distal end of the flexible post through the flexible post engagement opening to form a compression fit between the flexible post and the earring back and to engage the one or more protrusions of the flexible post, wherein the earring back flexible post engagement opening comprises at least one protrusion configured to engage the one or more protrusions of the flexible earring post.

21. An earring kit of claim 9, comprising:

an ornamental structure;

a flexible post extending from the ornamental structure, the flexible post comprising an elastic material capable of returning to its original shape and form after being compressed or deformed, wherein the flexible post takes a neutral position in the absence of an external force and wherein the flexible post includes one or more protrusions radially extending from the flexible post at predetermined locations to form stops configured to receive and retain an earring back to secure the earring to an ear, and an earring back having a flexible post engagement opening formed therethrough with a cross-section smaller in at least one dimension than a diameter of the flexible post and/or the one or more protrusions, wherein the earring back is configured to receive a distal end of the flexible post through the flexible post engagement opening to form a compression fit between the flexible post and the earring back and to engage the one or more protrusions of the flexible post, wherein the earring back flexible post engagement opening comprises at least one slit.

* * * * *